US005613926A

United States Patent [19]

Michaelson

[11] Patent Number: 5,613,926

[45] Date of Patent: Mar. 25, 1997

[54] RESISTANCE AND ASSISTANCE PHYSICAL TRAINING DEVICE

[76] Inventor: Kyron C. W. Michaelson, 8337 Penn Ave. So., Bloomington, Minn. 55431

[21] Appl. No.: 641,683

[22] Filed: May 2, 1996

Related U.S. Application Data

[62] Division of Ser. No. 356,529, Dec. 15, 1994.

[51] Int. Cl.[6] ..... A63B 21/12

[52] U.S. Cl. ..... 482/121; 482/124

[58] Field of Search ..... 273/26 R, 55 R; 482/121, 129, 124, 148, 122, 126, 74

[56] References Cited

U.S. PATENT DOCUMENTS

| | | | |
|---|---|---|---|
| 4,468,026 | 8/1984 | Roark | 482/129 |
| 4,830,365 | 5/1989 | March | 482/129 |
| 5,308,074 | 5/1994 | Dorotinsky et al. | 482/124 |

FOREIGN PATENT DOCUMENTS

| | | | |
|---|---|---|---|
| 6802124 | 8/1968 | Netherlands | 482/129 |

*Primary Examiner*—Jerome Donnelly

*Attorney, Agent, or Firm*—Joseph F. Breimayer

[57] ABSTRACT

An exercising and training method and apparatus particularly providing resistance and assistance physical training for athletes. An upper body harness is worn by the athlete and attached to one end of an inelastic rope that is extended around a rope guide pulley. The rope guide pulley is attached to a stationary object on a playing or exercise field. The other end of the rope is attached to one end of an elastic resistance and assistance member, including a latex hose, through a safety stop and connector. The other end of the elastic resistance and assistance member is attached through a further connector to a ground stake driven into the field at a preset angle to the stationary object. In use, the athlete stretches the latex hose between the ground stake and the rope guide pulley and the safety stop and connector prevents the passage of the latex hose around the pulley wheel. The athlete stays within an exercise area and does not cross the rope or the stretched latex hose while stretching the latex hose in resistance training or running during contraction of the hose in assistance training. If the latex hose breaks, the backlash is outside the exercise area, and the unrestrained recoil of the rope stops when the safety stop catches in the pulley.

6 Claims, 3 Drawing Sheets

RESISTANCE AND ASSISTANCE PHYSICAL TRAINING DEVICE

This division of copending application Ser. No. 08/356,529 filed on Dec. 15,1994.

BACKGROUND OF THE INVENTION

1. Field of the Invention

The present invention relates to certain new and useful improvements in a rope strength training exercise apparatus providing both resistance and assistance physical training. The apparatus is useful for speed and endurance training while running in place against a pulling force and for running in an arc both against and with a pulling force.

2. Description of the Background Art

Aerobic and strength training exercise apparatus have been devised to provide some resistance or constraint against which an athlete runs to gain strength and stamina. In addition, over-speed training apparatus for increasing burst running speed with the assistance of an applied force have been devised.

In one form of such apparatus, an elongated elastic member or hose, e.g. latex hose, is employed to provide the assistance or resistance when attached between the a stationary object and the athlete's body. For example, in training of football players, a length of elastic latex hose may be attached to a goalpost and the player, and the player may stretch the elastic hose while running away from the post in resistance training or may pre-stretch the elastic latex hose and run with it toward the goalpost on release of the tensioned hose. In the use of elastic hose for this purpose, accidents and serious injuries have occurred due to the backlash of the hose when it is stretched beyond its breaking point.

Other apparatus has been devised to provide resistance training alone, as shown for example in U.S. Pat. No. 3,519,269, wherein an athlete runs against a force on a tether rope, requiring a second person regulating the force on the tether rope. In this device, the rope is trained through a friction element that is attached to a fixed object. As the athlete jogs away from the fixed object, the rope is constrained by the friction element. The degree of constraint is adjustable by the second person. This apparatus does not allow for sustained training because the exercise can only be continue up to the length of the rope.

In a further U.S. Pat. No. 3,972,238, physical contact, resistance training apparatus is disclosed employing the combination of a length of rope and a compression or draw spring attached together and between a fixed post and the athlete. The athlete runs to the end of the rope and is forcefully stopped as the compression spring momentarily compresses. The compression or draw spring assembly is used because it is considered fail-safe. In the event that the compression spring fails, the draw rods would keep the assembly intact and not propel a portion of the spring at the athletes.

Other devices which attach to a stationary object, such as a doorknob or door, and disclosed in U.S. Pat. Nos. 4,073,490, 4,468,026 and 4,026,458, allow the user to jog in place or exercise against the tension of a stretched elastic cord member. In the '490 patent, an elastic cord and belt are employed. In the '458 patent, a spring type exercise device for in-place jogging is characterized by a pair of longitudinally extendible and retractable members whose extension is resisted by an adjustable bias force. Other in-place jogging devices simply require the attachment of a line to the person and to some heavy object which is then dragged over the floor or other supporting surface. In the '026 patent, the leg exerciser employs a stand and line guiding member to provide a useful operating angle for leg curl exercises.

Many different types of strength and conditioning apparatus have been developed that involve stretching an elastic member between handles or attached to a frame rather than lifting weights. U.S. Pat. No. 629,655, shows exercise equipment combining handles and elastic members including handles attached to ends of non-elastic ropes that runs through a stationary and movable pulleys to the ends of elastic cords. A floor to ceiling frame suspends the elastic cords and non-elastic ropes allows the pulleys freedom to swing outward from the wall when the handles are grasped and pulled.

Despite the considerable amount of effort that has been expended over the years in developing exercise and training apparatus, a need remains particularly for resistance and assistance speed training equipment that is effective and not dangerous to the athlete using it.

SUMMARY OF THE INVENTION

Accordingly, it is an object of the present invention to provide such apparatus and a method of use thereof particularly adapted for both resistance and assistance physical training that is safe to use.

A second object of the present invention is to provide an improved conditioning apparatus and method which is relatively inexpensive, portable, lightweight and easy to use in such resistance and assistance physical training.

Still another object of the invention to provide such an apparatus and method to allow the athlete to exercise smoothly over a wide exercise area while working against the resistance of or with the assistance of a force.

These and other objects of the invention are realized in assistance and resistance training apparatus particularly for use by an athlete running or jogging in an exercise area of an exercise surface adjacent a stationary object comprising: an elongated, elastic resistance and assistance member having an unstretched length and capable of stretching under tension from the unstretched length to a stretched length whereby force increases as stretched length increases and having a first connector end for attachment to a fixed point in relation to the exercise surface outside the exercise area and a second connector end, a length of inelastic rope having a first end and a second end, first means for connecting the second connector end with the second end of the inelastic rope, rope guiding means adapted to be attached to the stationary object for receiving the inelastic rope and for extending the inelastic rope and attached elastic resistance and assistance member in a first direction away from the exercise area while guiding the inelastic rope into the exercise area, a harness to be worn by the athlete having an attachment point, and second means for connecting the first end of the inelastic rope to the harness attachment point to allow force to be applied by the athlete during movement in the exercise area along the inelastic rope, through the guiding means and to the attached elastic resistance and assistance member extended in the first direction, whereby backlash of the stretched elastic resistance and assistance member upon sudden release of the force thereof is along the first direction away from the exercise area.

In accordance with a further aspect of the invention, the apparatus further comprises safety stop means formed with the first connecting means for interacting with the rope guiding means for preventing movement of the inelastic rope second end through the rope guiding means to thereby limit the stretched length of the elastic resistance and assistance member achieved by the athlete pulling through the harness on the inelastic rope.

In a preferred embodiment, the elastic resistance and assistance member is formed of a length of latex hose and has the safety stop means and first connecting means attached to one end as an enlargement thereof incapable of passing through the rope guiding means.

In accordance with the invention, an improved method of using an assistance and resistance training apparatus particularly for use by an athlete running or jogging in an exercise area of an exercise surface further comprises the steps of: anchoring one end of an elastic resistance and assistance member to a first point outside the exercise area, the elastic resistance and assistance member having an unstretched length and a characteristic that stretch force increases as stretch length increases, connecting a second end of the elastic resistance and assistance member to a safety stop and to a first end of an inelastic rope having a length that exceeds the unstretched length of the elastic resistance and assistance member, extending the connected inelastic rope and elastic resistance and assistance member in a first direction outside the exercise area, passing an intermediate portion of the inelastic rope extending in the first direction through a rope guiding member that is sized to permit passage of the rope and prevent passage of the safety stop and that changes the direction of extension of the inelastic rope, fixing the rope guiding member at a stationary position adjacent to the exercise area and directing the extension of the intermediate portion of the inelastic rope into the exercise area; attaching a second end of the inelastic rope to the athlete's body to create a resistance force on the athlete as the athlete moves away from the stationary position to an exercise tension position in the exercise area dependent on the stretch length of the elastic resistance and assistance member and to create an assistance force on the athlete as the athlete moves from the exercise tension position toward the stationary position.

Preferably the method further comprises the steps of fixing the rope guiding member to a stationary support located a distance N times the unstretched length of the elastic resistance and assistance member from the first point and located near an end of an exercise area that will permit generally arcuate motion of the athlete across the exercise area through 90° centered on the rope guiding member and moving away from the elastic resistance and assistance member, allowing the athlete to avoid being exposed to risk of injury that may occur if the stretched resistance and assistance member breaks and backlashes toward the rope guiding member and stationary support or backlashes toward the first point.

The improved conditioning apparatus allows an individual to exercise without requiring an assistant or trainer. The improved apparatus operates in a manner that prevents injury to the athlete or a trainer situated near the athlete if the elastic resistance and assistance member or latex hose backlashes when stretched beyond its breaking point.

BRIEF DESCRIPTION OF THE DRAWINGS

Other objects, advantages and features of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENT

Figure 1:
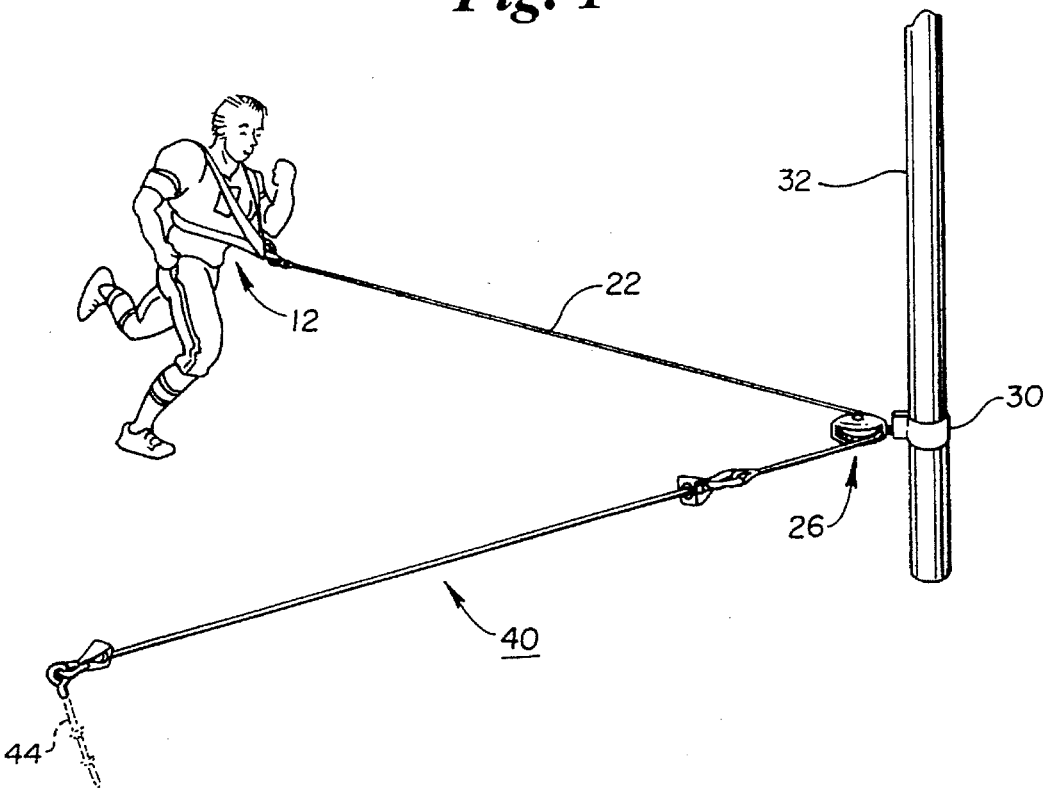
FIG. 1 s a perspective view of the training apparatus constructed in accordance with the principles of the invention and illustrating how it is used in assistance training.
Figure 2:
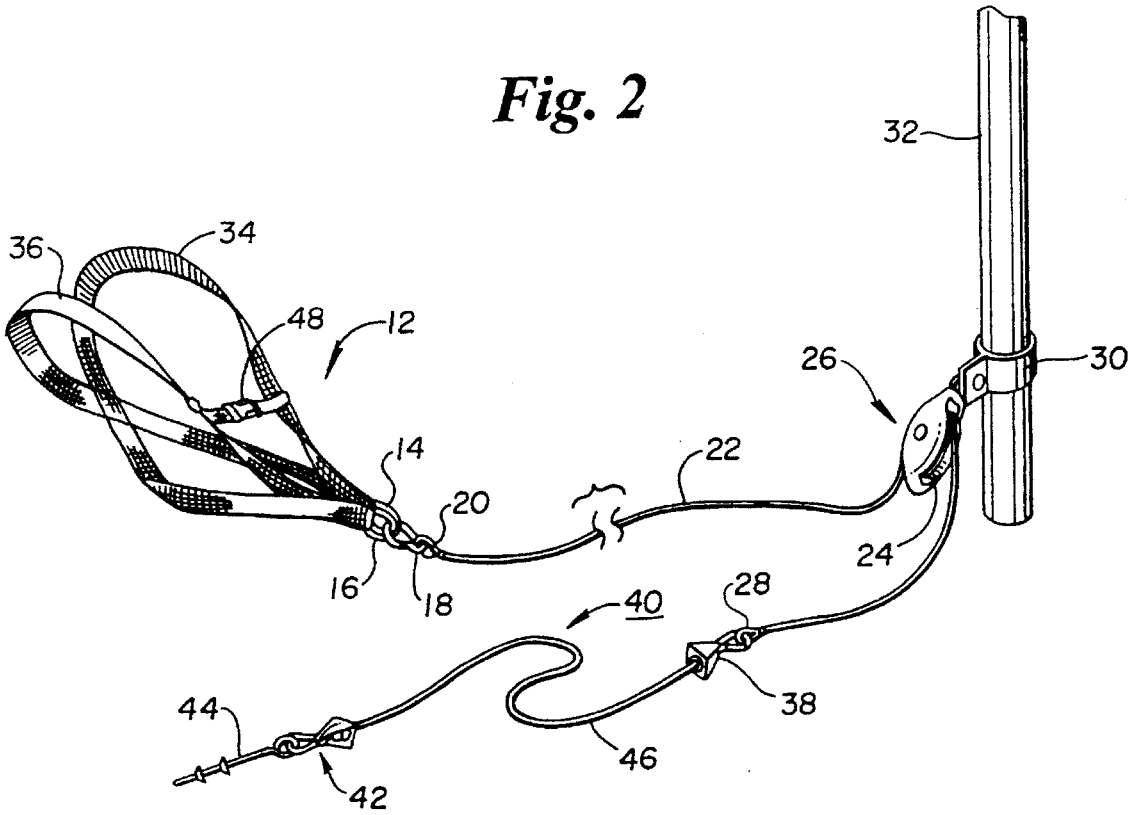
FIG. 2 s a further enlarged perspective view of the training apparatus showing the interconnection of its components.

FIGS. 1 and 2 show the exercising and training apparatus of the present invention in use and in enlarged detail. The athlete 10 wears a chest harness 12 that is detachably connected by a pair of D-rings 14 and 16 to a snap connector 18 attached to a first loop end 20 of an inelastic, cable, tether or rope 22, e.g. a nylon rope. An intermediate portion of the rope 22 extends around a rotatable wheel 24 of a rope guiding pulley 26 and terminates in a second loop end 28. The pulley 26 is fixed by strap 30 of nylon webbing or other materials to a stationary object, e.g. a goalpost or other post 32 on the edge of a playing field.

The second rope loop end 28 is connected to a first end safety stop and connecting means or connector 38 of an elastic resistance and assistance member 40 having a second end connector 42 attached to a stake 44 driven into the field. The elastic resistance and assistance member 40 also preferably comprises a length of latex tubing or hose 46. The latex tubing or hose 46 demonstrates a characteristic that the spring tension force stored in the hose 46 increases as its stretched length increases.

The harness 12 is shown in FIG. 1 fitting the athlete 10 so that the D-rings 14 and 16 are positioned in front of the athlete's chest for use in assistance training. The harness 12 comprises nylon webbing sewn together at crossover point to form two criss-cross shoulder loops 34 and 36. A strap and snap connector 48 extends between the shoulder loops 34 and 36 and can be released to allow the athlete 10 to position the shoulder loops 34 and 36 and then snapped together to stabilize the harness 12 in use. The D-rings 14 and 16 are attached to free ends of the shoulder loops 34 and 36 and are drawn together when snapped into the rope snap connector 18.

The harness 12 can also be worn in the reverse manner from that shown in FIG. 1 with the D-rings at the back for resistance training. The harness 12 centers the force on the rope 22 in the upper thorax area, specifically the center of the back if moving backwards for resistance training or in the breastbone if moving forward for assistance training, so that the collarbone or ribs do not receive the forces created pulling on the rope 22.

Figure 3:
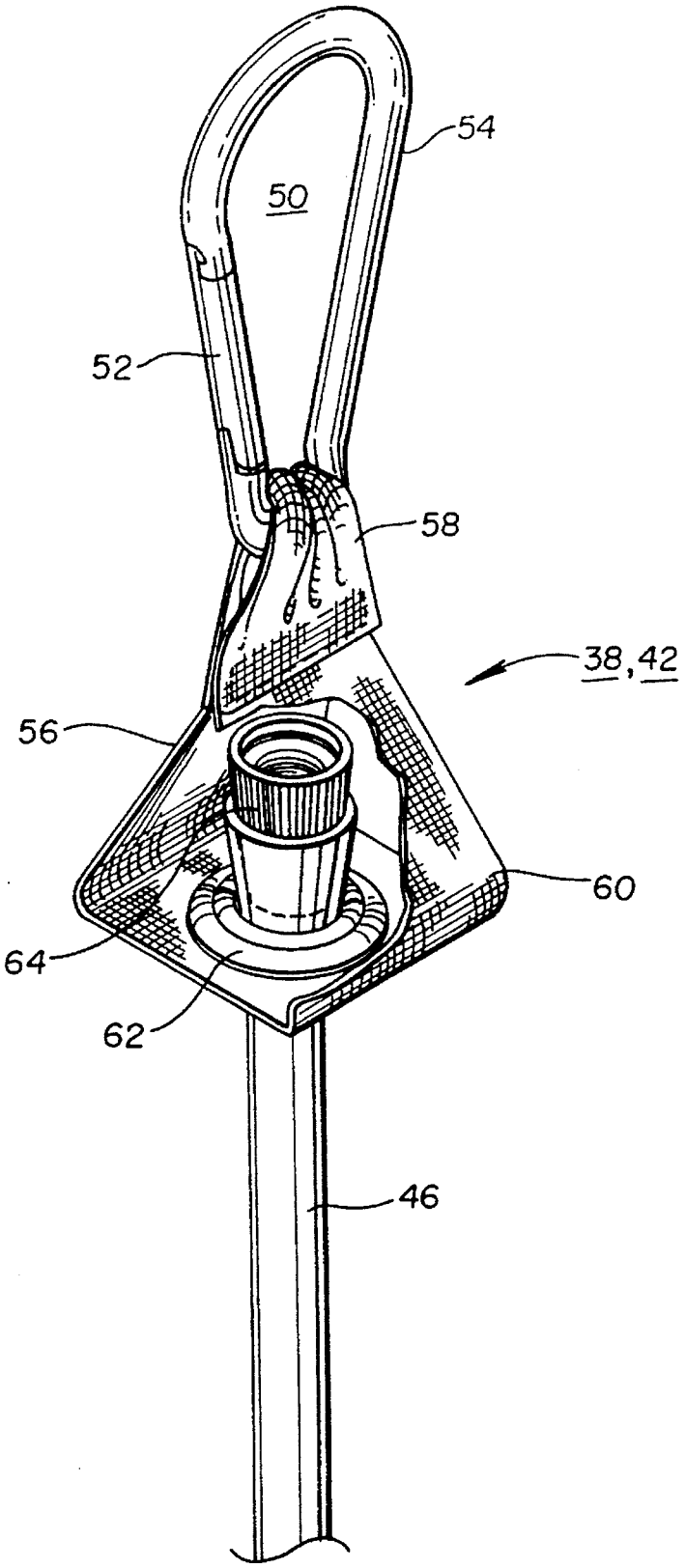
FIG. 3 s an enlarged partial section view of the attachment end and safety stop for interconnecting a length of elastic tubing with an end of inelastic rope.

FIG. 3 shows the safety stop and connector 38 in greater detail. A thumb actuated spring snap link 50, having a pivotal gate section 52 and a body section 54 is connected to the end of the elastic latex hose 46. A length of nylon webbing 56 is sewn in a first loop 58 around the body section 54 and in a second loop 60. The second loop 60 has a hole formed in it that is surrounded by a rubber grommet 62. The grommet 62 traps the end of the latex hose 46 enlarged by an electrical wire nut 64. In assembly, the wire nut 64 is forced into the open lumen of the elastic hose 46 after the latex hose 46 is extended through the grommet 62. For ease of illustration of these parts, the wire nut 64 is shown extending out of the lumen of the elastic hose 46. In practice, the wire nut 64 is forced further into the lumen of the latex hose 46 to fully trap it inside the lumen.

The latex hose 46 is preferably about 0.625 inches in outside diameter and 0.375 inches in inside diameter and is highly elastic. The hose 46 may be readily stretched to accommodate the wire nut 64 and stretched lengthwise up to three times its normal length.

The second end connector 42 may be constructed in the same fashion as the safety stop and connector 38. The snap connector 18 may also consist of a thumb actuated spring snap link 50.

Referring back to FIG. 2, it may be observed that the safety stop and connecting means 38, including the snap link 50, are dimensioned so that the assembly will not pass around the pulley wheel 24 and between the pulley wheel 24 and the adjacent pulley sheaves. Thus, the elastic resistance and assistance member 40 cannot be stretched into and past the rope guiding pulley 26.

Figure 4:
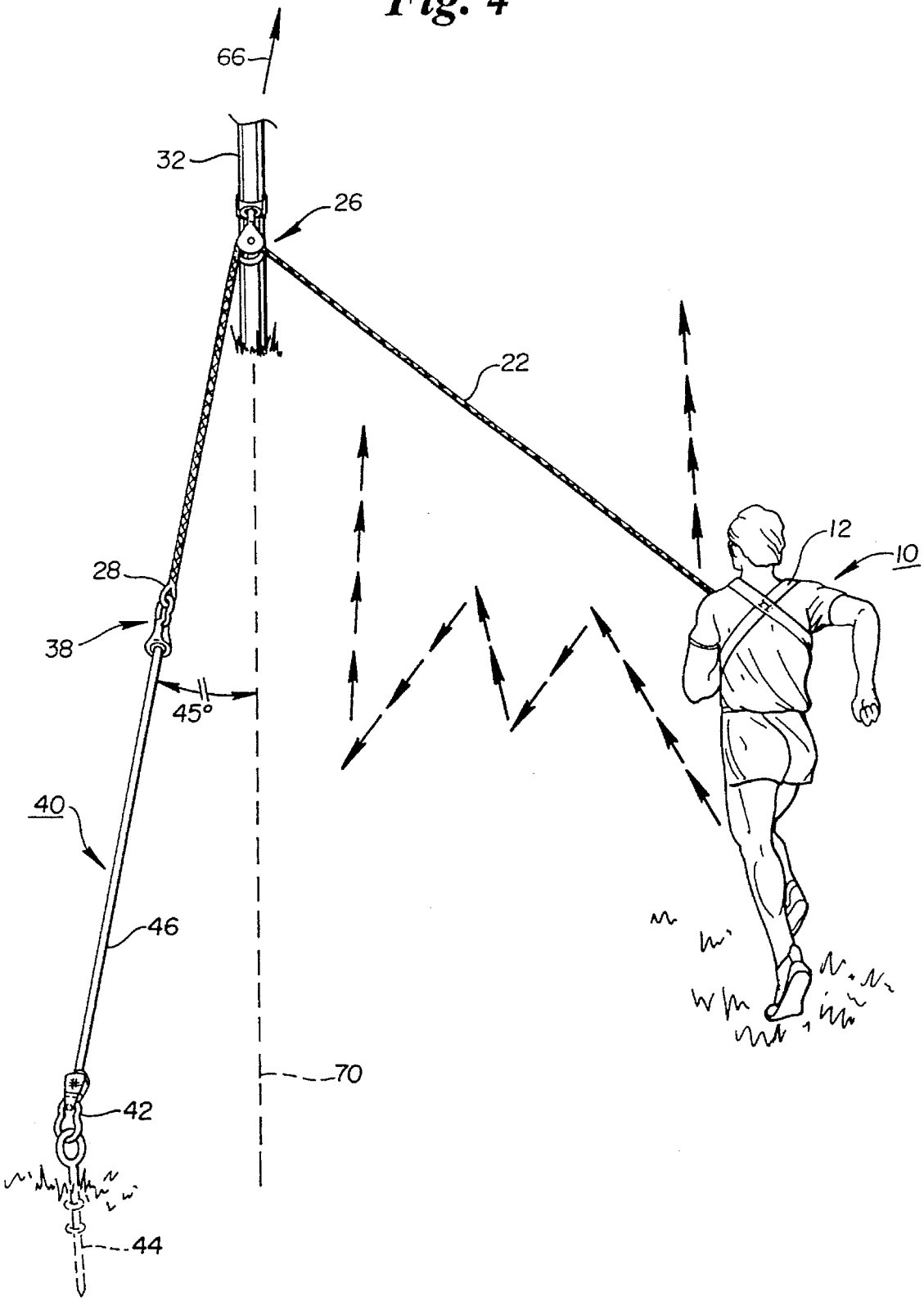
FIG. 4 is a top perspective view depicting some of the possible running patterns of an athlete strapped to the training apparatus shows the layout of the rope and latex and the range of movement of the athlete.

Turning to FIG. 4, it depicts the athlete 10 in position to run in the exercise area or quadrant to the right of the boundary line 70 with the assistance of the elastic resistance and assistance member 40. As also shown in FIG. 1, as the athlete 10 runs, the rope 22 moves around the pulley wheel 24 acting as a rope guiding means as the elastic hose 46 either is stretched or contracts. The forces created by the stretching or contraction of the elastic hose 46 are transmitted through the connection at the safety stop and connecting means 38 to the rope 22 and through the rope 22 to harness 12 worn by the athlete 10. The connected together, elastic resistance and assistance member 40 and a portion of the rope 22 extend in a first direction 66, and the remaining portion of the rope 22 extends into the exercise area or quadrant to the right of the boundary line 70.

The elastic resistance and assistance member 40, specifically latex hose 46, has an unstretched length y, and the rope 22 has a length that is preferably at least four times the unstretched length y. The rope guiding pulley 26 is detachably connected to the stationary post 32, and the anchoring stake 44 is anchored to the field a distance, N*y, that is N times the unstretched length of the elastic resistance and assistance member 40 from the first stationary post 32. In a preferred embodiment, the length y is 25 feet and the rope 22 is 100 feet long. Using these lengths, the stake 44 is preferably located 100 feet from the post 32, leaving about 25 feet of the rope 22 extending from the pulley 26 to the first loop end 20.

The athlete's motion away from the stationary post 32 and rope guiding pulley 26 creates tension in the rope 22, pulling the medial portion of the rope through the rope guiding pulley 26 and pulling the attached end of the rope 22 and the safety stop and connector 38 toward the pulley 26 as the latex hose 46 is stretched in the first direction. It is not recommended that the latex hose be stretched beyond three times its relaxed length or a 75 foot limit in this example. If it is inadvertently stretched to the 100 foot length, the safety stop and connector 38 strikes the rope guiding pulley 26 preventing the latex hose 46 from being elongated further.

The layout of the exercise area on the field shown in FIGS. 1 and 4 is also important to the safety objects of the invention. The stationary object or post 32 should be located along a side of an exercise area providing a 90° quadrant running area to the right or left of the post 32. The stake 44 is pounded into the field at about a 45° angle centered in the other quadrant to the left (as shown in FIGS. 1 and 4) or right of the post 32, respectively. In the example described above, the stake 44 is positioned so that the 25 feet of the latex hose 46 and 75 feet of the inelastic nylon rope 22 extend between the stake 44 and the rope guiding pulley 26 in the first direction away from the exercise area or quadrant. It should be noted that the preferred 45° angle of the first direction 66 to the exercise area boundary line 70 has been compressed in FIG. 4 to fit the drawing sheet width.

During assistance training, the athlete 10 puts on the harness 12 as shown, attaches snap connector 18 to the harness 12 and then backs up to stretch the latex hose 46 toward the pulley 26. By moving away from the pulley 26, the athlete gets a wide range of motion, laterally through the quadrant toward the field edge or goal line and longitudinally with the contributing force of the stretched latex hose 46.

As shown in FIG. 4, after backing up, the athlete 10 runs forward to receive an immediate acceleration effect in a powerful burst of speed when the stretched latex hose 46 is released. To run sideways with acceleration, the athlete follows the same setup procedure but runs side to side in any direction or zig zag pattern within the quadrant.

For resistance training, the athlete 10 may either run backwards from the position shown in FIGS. 1 or 4 or the harness 12 may be reversed. In the latter case, the athlete 10 runs forward or sideways or runs in place against the force of the latex hose 46 as it stretches. Care should be taken to avoid stretching the latex hose 46 beyond the recommended limit.

By staying to the right of the boundary line 70 that and not crossing over the stretched latex hose 46, the athlete 10 minimizes the risk of injury if the hose 46 were to break. The hose backlash on breaking is along the first direction 66 toward the anchor stake 44 or toward the stationary post 32. In addition, the safety and connector 38 prevents the latex hose 46 from passing through the rope guiding pulley 26 and injuring the athlete 10. Moreover, the unrestrained recoil of the rope 22 stops when the safety stop and connector 38 catches in the pulley 26.

In use, the athlete 10 may move a distance from the rope guiding pulley 26 that is approximately equal to twice the unstretched length of the elastic resistance and assistance member 40, and creating a resistance force on the athlete 10 that increases as the distance from the rope guiding pulley 26 increases, The athlete 10 may move approximately perpendicular to the direction of the rope 22 from the athlete to the anchored rope guiding pulley 26 in an arcuate motion centered on the rope guiding pulley 26 or post 32, giving the athlete 10 the opportunity to exercise in a wide range of motion, The athlete 10 may also move a greater distance from the rope guiding pulley 26 until desired resistance is reached or until a maximum resistance is reached by stretching the elastic resistance and assistance member 40 until the intermediate portion of the rope 22 has passed through the guiding member and the safety stop 38 reaches the rope guiding pulley 26 whereupon the elastic resistance and assistance member 40 is elongated to not more than three times more than the unstretched length.

While a preferred embodiment of the invention and variations thereof have been described in detail, other modifications and methods of using and medical applications for the same will be apparent to those of skill in the art. Accordingly, it should be understood that various applications, modifications, and substitutions may be made of equivalents without departing from the spirit of the invention or the scope of the claims.

PARTS LIST FOR FIGS. 1–4 athlete 10
chest harness 12
pair of D-rings 14 and 16
snap connector 18
first loop end 20
inelastic rope 22
rotatable wheel 24
rope guiding pulley 26
second loop end 28
pulley attachment strap 30
post 32
criss-cross shoulder loops 34 and 36
safety stop and connecting means or connector 38
elastic resistance and assistance member 40
second end connector 42
stake 44
latex tubing or hose 46
strap and snap connector 48
spring snap link 50
pivotal gate section 52
body section 54
nylon webbing 56
first loop 58
second loop 60
rubber grommet 62
electrical wire nut 64
first direction 66
exercise area boundary line 70

What is claimed is:

1. An improved method of using an assistance and resistance training apparatus particularly for use by an athlete moving by running or jogging in an exercise area further comprises the steps of:

anchoring a first end of an elongated elastic resistance and assistance member to a first point outside said exercise area, said elastic resistance and assistance member having an unstretched length and the capacity to be stretched to a stretch length under an applied stretch force such a characteristic that stretch force increases as stretch length increases until an elastic resistance limit iS reached and backlash of the stretched elastic resistance and assistance member may occur upon sudden release of the stretch force thereof;

connecting a second end of said elastic resistance and assistance member to a safety stop and to a first end of an inelastic rope having a length that exceeds the unstretched length of said elastic resistance and assistance member;

extending the connected inelastic rope and elastic resistance and assistance member in a first direction that is away from said exercise area;

passing an intermediate portion of said inelastic rope extending in said first direction through a rope guiding member that is sized to permit passage of said rope therethrough during the stretching of said elastic member and to prevent passage of said safety stop thereto and that changes the direction of extension of said inelastic rope into the exercise area;

restraining said rope guiding member at a stationary position in relation to said exercise area and directing the extension of the intermediate portion of said inelastic rope into said exercise area in a range of direction other than said first direction; and attaching a second end of said inelastic rope to the athlete's body to create a resistance force on the athlete as the athlete moves away from said stationary position to an exercise tension position in said exercise area and increases the stretch length of said elastic resistance and assistance member and to create an assistance force on the athlete as the athlete moves from the exercise tension position toward the stationary position anal decreases the stretch length.

2. The method of claim 1 wherein said step of fixing said rope guiding member to a stationary support further comprises fixing said rope guiding member to said stationary support near a border of an exercise area that will permit generally arcuate motion of said athlete across said exercise area through 90° centered on said rope guiding member and moving away from said elastic resistance and assistance member, allowing the athlete to avoid being exposed to risk of injury that may occur if the stretched resistance and assistance member breaks and backlashes toward said rope guiding member and stationary support or backlashes toward said first point.

3. The method of claim 1 wherein said rope has a length that is at least N times said unstretched length of said elastic resistance and assistance member, whereby upon attachment of said first connector end of said elastic resistance and assistance member to said first point, the combined length of said elastic resistance and assistance member unstretched length and said portion of the length of said rope extending in said first direction is about N times the unstretched length of said elastic resistance and assistance member from the first stationary object, thereby allowing said elastic resistance and assistance member to be stretched up to N times its length in said first direction.

4. The method of claim 1 wherein said connecting step further comprises:

providing a safety stop means at the connection os said elastic member with said inelastic rope for interacting with said rope guiding means for preventing movement of said inelastic rope second end through said rope guiding means to thereby limit the stretched length of said elastic resistance and assistance member achieved by the athlete pulling through said harness on said inelastic rope.

5. The method of claim 4 wherein:

said elastic resistance and assistance member is formed of a length of latex hose; and said safety stop means and said first connecting means are attached to one end of said length of latex hose and are incapable of passing through said rope guiding means.

6. The method of claim 1 wherein said rope has a length that is at least N times said unstretched length of said elastic resistance and assistance member, whereby upon attachment of said first connector end of said elastic resistance and assistance member to said first point, the combined length of said elastic resistance and assistance member unstretched length and a medial portion of said rope extending in said first direction is about four times the unstretched length of said elastic springing and assisting member from the first stationary object, thereby allowing said elastic resistance and assistance member to be stretched up to four times its length in said first direction.

* * * * *